US006341459B1

(12) United States Patent
Bates et al.

(10) Patent No.: US 6,341,459 B1
(45) Date of Patent: Jan. 29, 2002

(54) METHOD AND APPARATUS FOR EXPEDITED CONSTRUCTION OF A BUILDING

(76) Inventors: Bobby L. Bates, c/o Triple Seven 7630 Tholl Dr., Reno, NV (US) 89506; Sydney L. Bates, 5575 Alcorn Rd., Fallon, NV (US) 89406

( * ) Notice: Subject to any disclaimer, the term of this patent is extended or adjusted under 35 U.S.C. 154(b) by 0 days.

(21) Appl. No.: 09/520,563

(22) Filed: Mar. 8, 2000

(51) Int. Cl.[7] ..... E02D 27/42
(52) U.S. Cl. ..... 52/299; 52/169.9; 52/741.15
(58) Field of Search ..... 52/296, 299, 745.01, 52/745.02, DIG. 11, 741.1, 741.15, 169.9

(56) References Cited

U.S. PATENT DOCUMENTS

| | | | |
|---|---|---|---|
| 2,074,000 | A | 3/1937 | Streich |
| 3,659,388 | A | 5/1972 | Sirianni |
| 4,455,792 | A | 6/1984 | Pasco |
| 5,685,115 | A | 11/1997 | Colfer |

*Primary Examiner*—Carl D. Friedman
*Assistant Examiner*—N. Slack

(57) ABSTRACT

A steel framed building which includes prefabricated steel frames, unique pier posts, POLYSTYRENE panels, and an assembly method which in combination provides an expedited overall time frame of 21 days from start to finish.

7 Claims, 18 Drawing Sheets

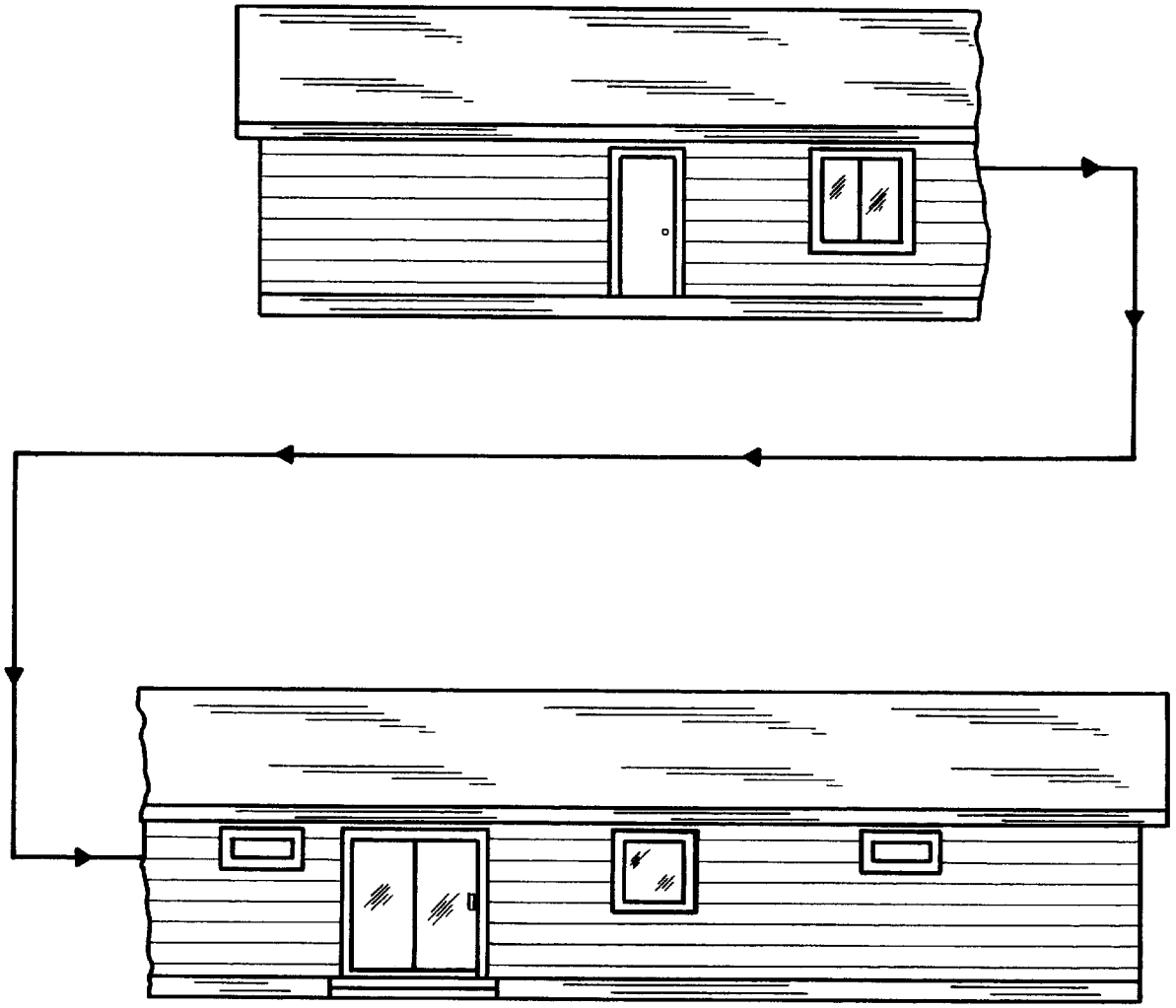
FIG. 13-A

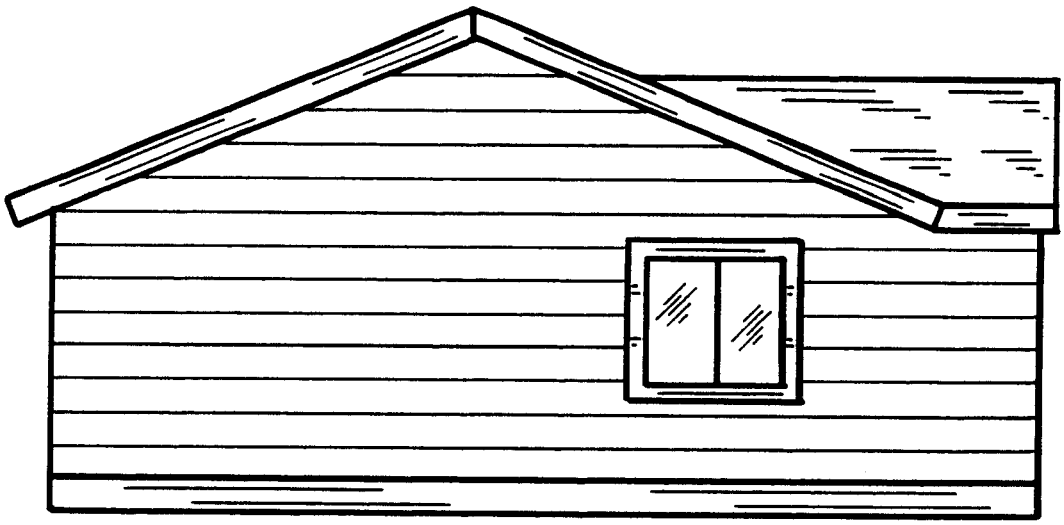
FIG. 13-B
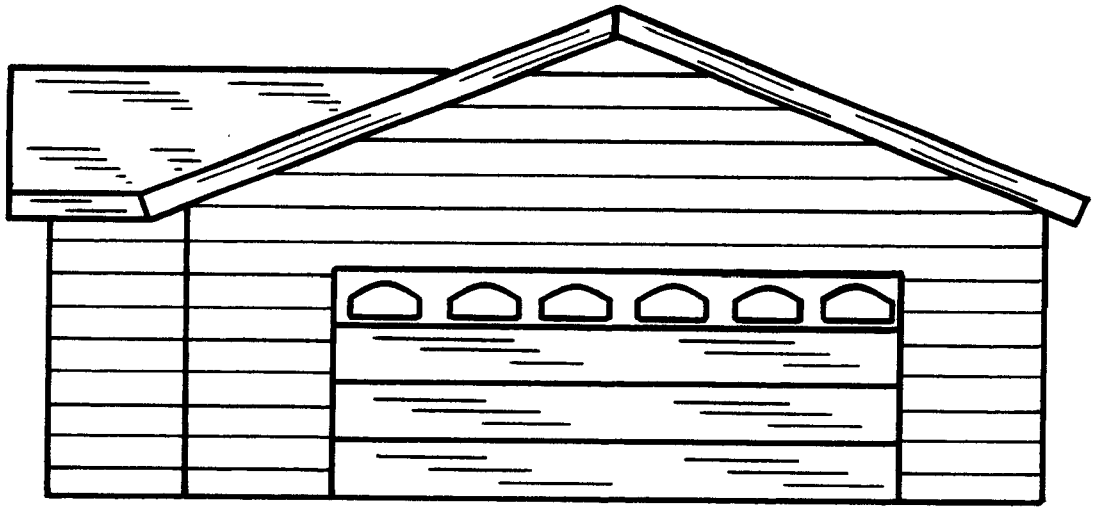
FIG. 13-C

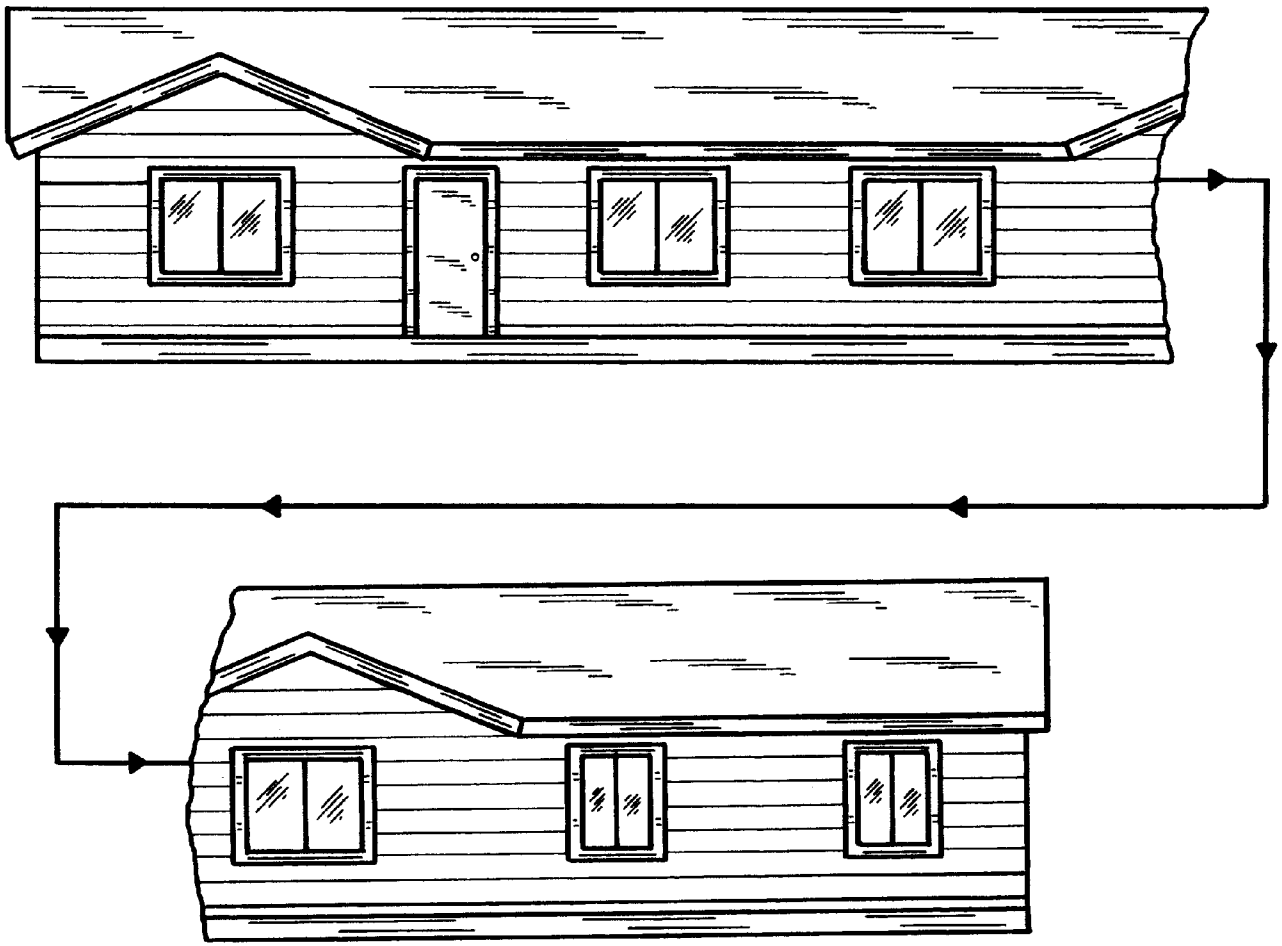
FIG. 13-D

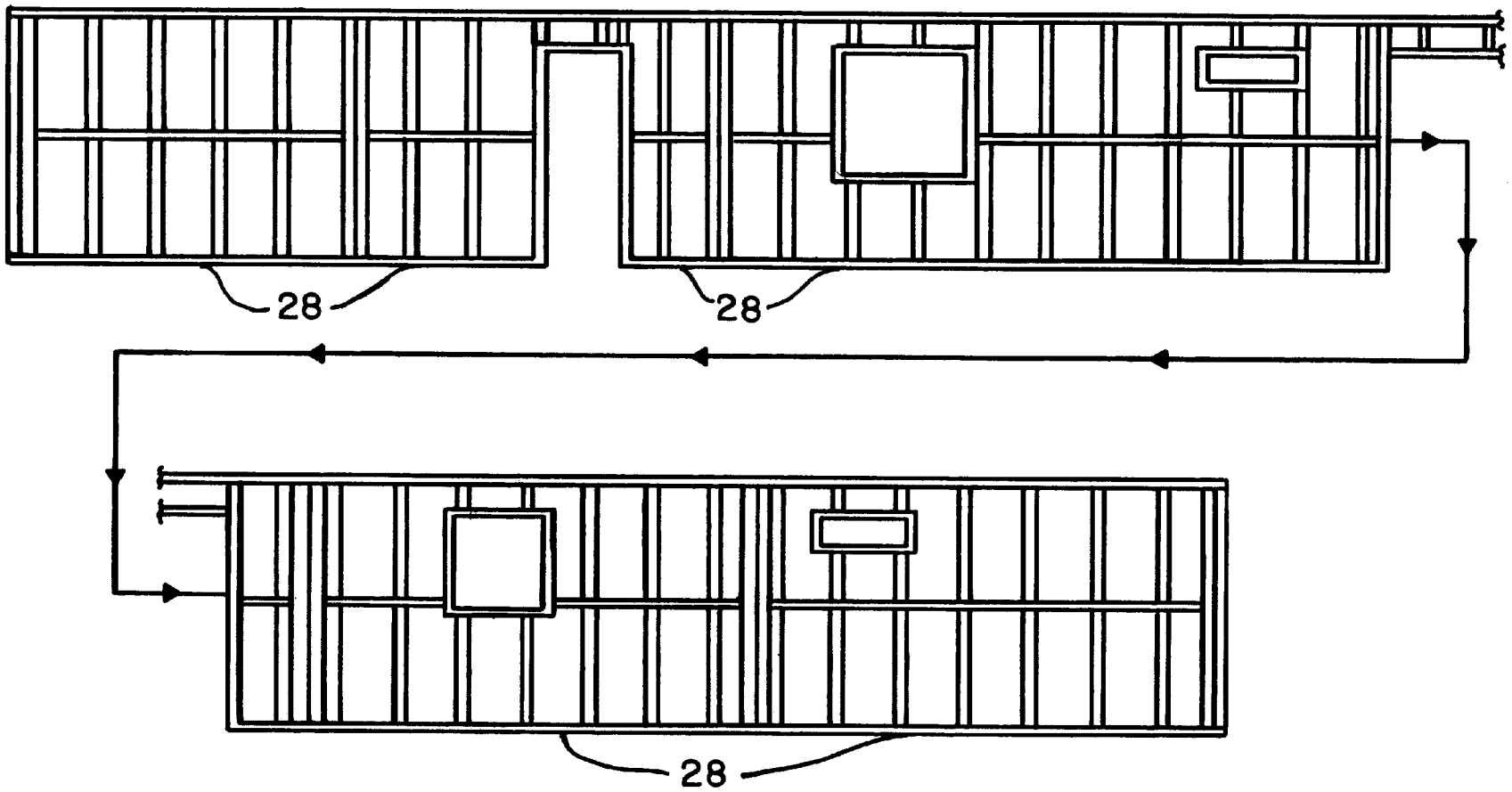
FIG. 16-A

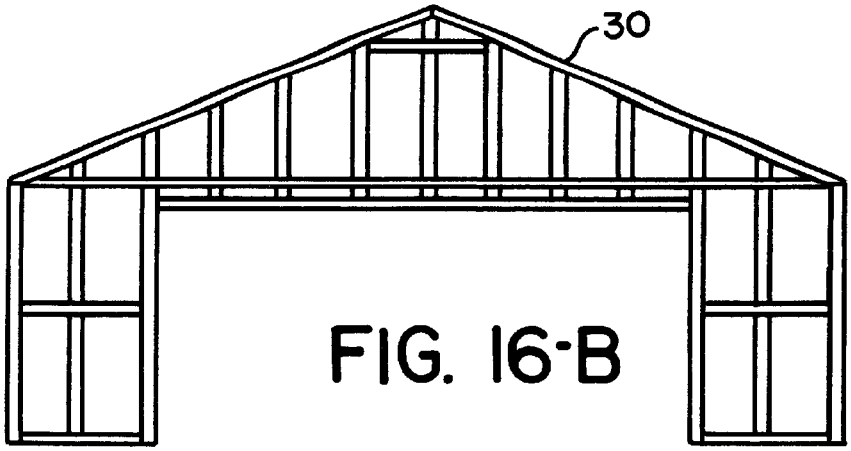
FIG. 16-B
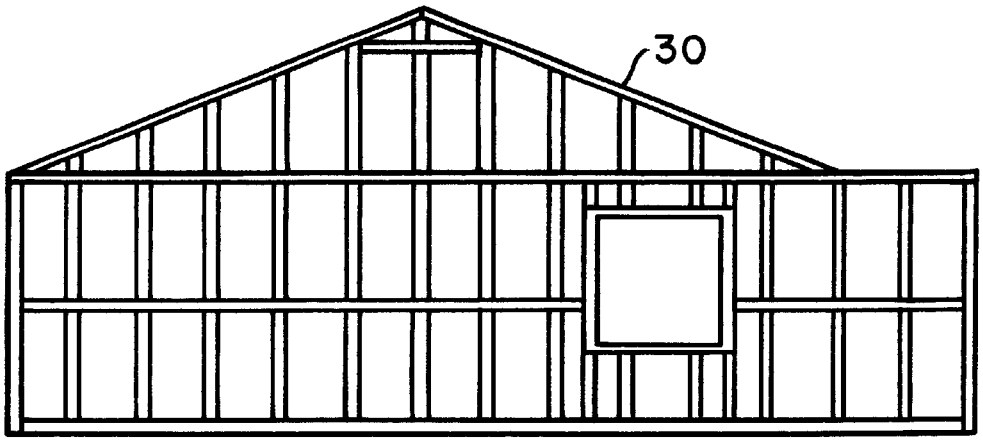
FIG. 16-C
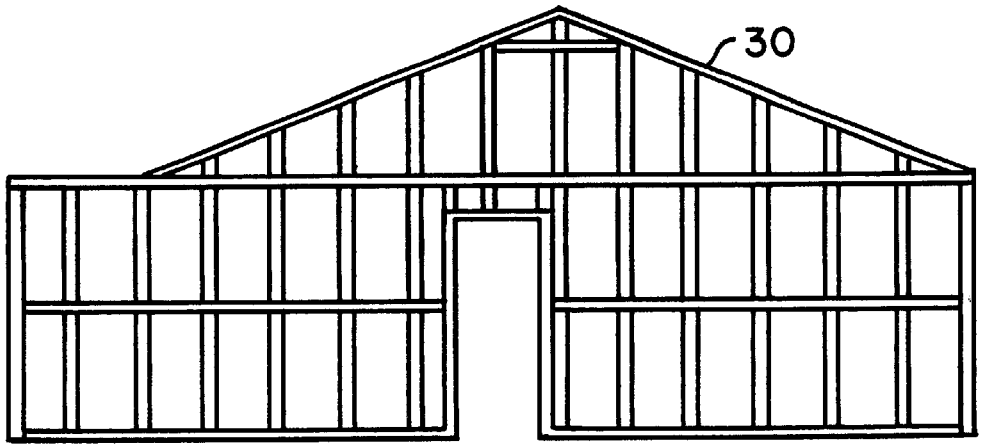
FIG. 16-D

METHOD AND APPARATUS FOR EXPEDITED CONSTRUCTION OF A BUILDING

This invention relates to construction of steel framed buildings but more particularly relates to a steel framed building incorporating prefabricated steel frames, unique pier posts, POLYSTYRENE panels, and an assembly method, which in combination provides an expedited overall time frame from start to finish for completion of the building.

BACKGROUND OF THE INVENTION

In the past many different types of construction techniques for the assembly of buildings have been taught. However, each have inherent disadvantages and drawbacks which must be addressed and resolved.

For example, the use of conventional wood frame building material has increased in expense while the quality of that wood has fallen and forest supplies dwindle. Such is the consequence of over consumption and environmental regulations, as well as restrictions on logging intended to protect the forests. Those factors give incentive to the use of alternative building materials, such as steel.

The use of steel also leads to the conservation of trees. As steel is the most recycled material in the world. More steel is recycled than paper, aluminum, glass and plastic combined. Thus there is an abundance of material available for use in the construction of buildings.

Still further steel-framing material is stronger than wood and has the highest strength-to-weight ratio of any residential building material.

Therefore, many prior art patents attempt to provide a steel framed constructed building which is economical and environmentally friendly, such as U.S. Pat. Nos. 2,074,000, 3,659,388, 4,455,792 and 5,685,115.

However, most of the references still require complex assembly and must be constructed on a preformed foundation. This is very time consuming and the overall time frame for completion from beginning to end is usually at least 90 days.

Also within the known prior art, they do not include the use of POLYSTYRENE panels which provides numerous advantages. Such as a steel framed building in combination with POLYSTYRENE panels is rot proof, termite proof, vermin proof, carpenter ant proof, warp proof, split proof, crack proof, non-toxic, does not add fuel to a fire, and is engineered for the highest seismic rating.

SUMMARY OF THE INVENTION

It is therefore a primary object of the present invention to provide a method and apparatus for expedited construction of steel framed building and reduces overall construction time from beginning to end and the completed building is ready for occupancy in 21 days.

A very important object of the present invention is to provide a method and apparatus for expedited construction of a steel framed building which does not require pouring of a foundation before construction begins, thus eliminating wasted time awaiting the foundation to cure.

A further object of the present invention is to provide a method and apparatus for expedited construction of a steel framed building which is easily constructed from prefabricated metal frames at the point of manufacture and is then transported to the work site and assembled. With the metal frames being preformed into wall sections, partitions, roofing trusses, etc.

Yet another object of the present invention is to provide a method and apparatus for expedited construction of a steel framed building which is extremely strong, and eliminates the need for internal load bearing walls. Therefore the interior of the building can be of any floor plan of choice. Also, the ceiling can be vaulted at no additional costs, and there is no need for an attic unless desired.

Also another object of the present invention is to provide a method and apparatus for expedited construction of a steel framed building wherein the above noted metal frames are prefabricated into various cookie-cutter configurations with each being numbered for easy assembly, similar to an erector set. This allows for 20 different designs or 5 different floor plans to be chosen from.

Still further the above noted configurations can be interconnected in multiple variations which allow for unique designs according to consumer specifications, such as windows and doors can easily be variably positioned.

Another object of the present invention is to provide a method and apparatus for expedited construction of a steel framed building which includes panels made from POLYSTYRENE which is sandwiched between O.S.B. and are used throughout the building forming the walls, floor, ceiling, etc.

A very important object of the present invention is to provide a method and apparatus for expedited construction of a steel framed building wherein the above noted POLYSTYRENE floor is most suitable for seniors, unlike cement floors which can cause numerous physical ailments, such as back and leg disorders.

Yet another object of the present invention is to provide a method and apparatus for expedited construction of a steel framed building wherein the above note POLYSTYRENE panels provide excellent insulation which is higher then regulations require. Thus reducing heat and cooling costs for the consumer.

Also another object of the present invention is to provide a method and apparatus for expedited construction of a steel framed building which is very easy to assemble as each of the components are numbered or marked and simply bolted together and no additional attachment means are required. Thus, eliminating the need for highly skilled workers and this also reduces consumer costs.

Still another object of the present invention is to provide a method and apparatus for expedited construction of a steel framed building wherein the job site is much safer than typical construction sites of prior art buildings, as there is no need for dangerous tools and there is no scrap.

Another object of the present invention is to provide a method and apparatus for expedited construction of a steel framed building which eliminates expansion, contraction, warping, twisting, etc. Such as typically incurred with wood buildings wherein wallboard blemishes, sagging squeaking floors, and wavy ceilings are a common occurrence.

Yet another object of the present invention is to provide a method and apparatus for expedited construction of a steel framed building wherein the completed building easily complies with all regulations and building codes, especially fire, seismic and snow-load regulations.

Also another object of the present invention is to provide a method and apparatus for expedited construction of a steel framed building which allows for different internal and external finishes, such as stucco, wood, brick, siding, or any other material of choice.

Still a further object of the present invention is to provide a method and apparatus for expedited construction of a steel framed building wherein the finished building can be constructed 100% from recycled materials.

Other objects and advantages will be seen when taken into consideration with the following specification and drawings.

BRIEF DESCRIPTION OF THE DRAWINGS

FIG. 13 is substantially an overview showing exterior construction of the rear, sides and front of the finished structure.

FIG. 16 is substantially an overview illustrating different configurations for the steel wall frame members.

DETAILED DESCRIPTION OF THE DRAWINGS

Figure 1:
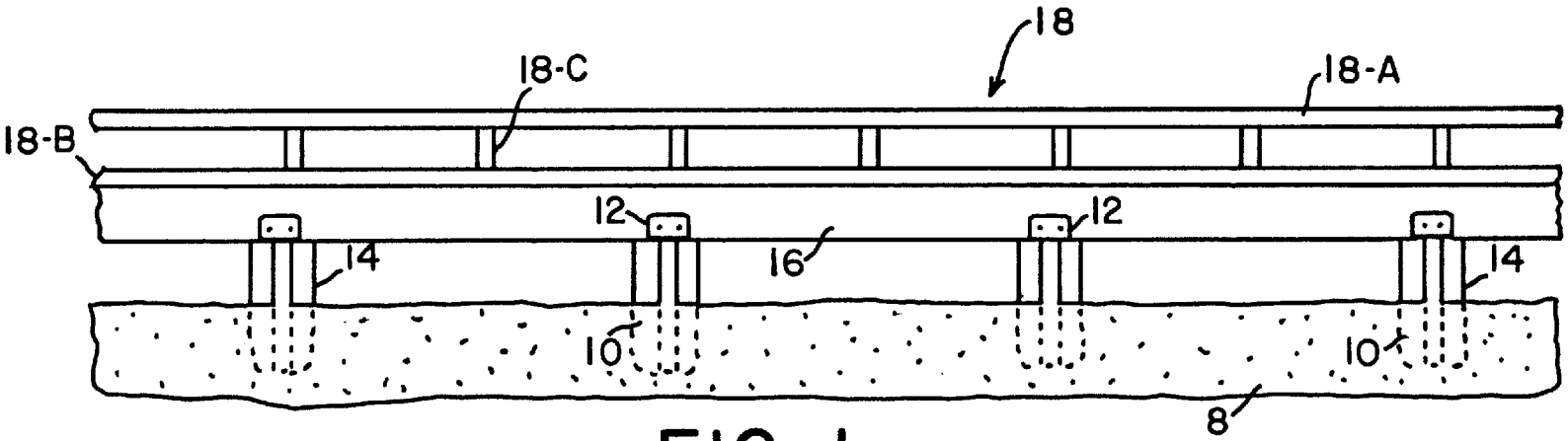
FIG. 1 is substantially a frontal plan view for partial assembly of foundation blocks, pier posts, a girder and a floor joist.
Figure 2:
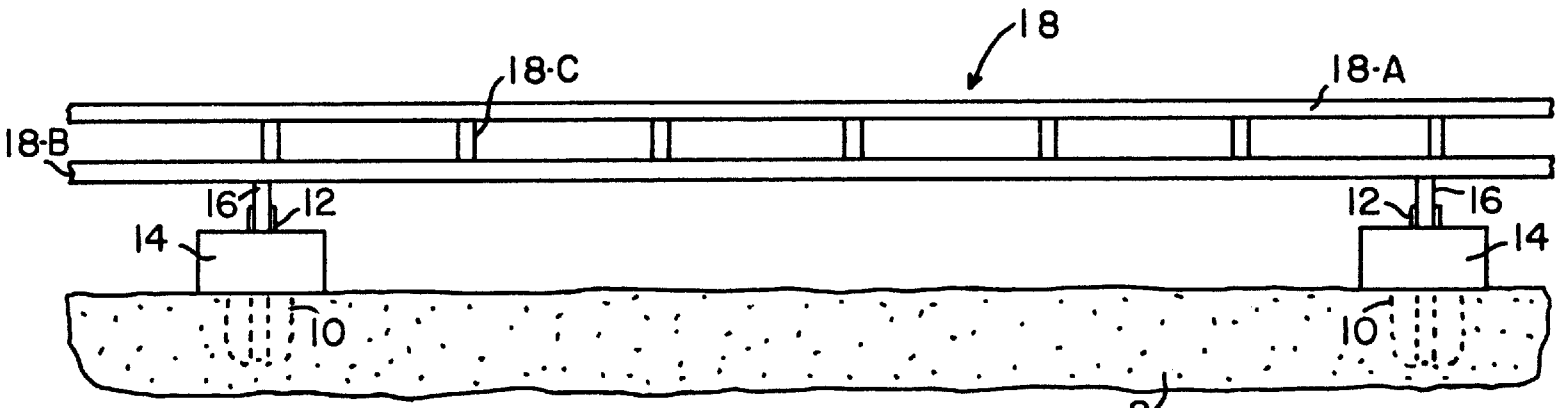
FIG. 2 is substantially a side view of FIG. 1.

Referring now in detail to the drawings wherein like characters refer to like elements throughout the various views.

The present invention relates in general to the construction and assembly of a steel framed building which provides an assembly method that expedites the construction time from start to finish. For example, the building can be completely finished and ready for use within as little as 21 days. The following describes and illustrates the overall plan and construction of a 1,140 square foot home. However the present invention is not to limited to the type of home, the construction or assembly as taught herein as the following is only exemplary of one embodiment but numerous embodiments may be constructed according to engineering choice.

FIGS. 1–8 substantially illustrate what is accomplished on the first day of construction after the building site or ground (8) has been excavated and leveled. The first step is to dig holes (10) for receiving pier posts (12) therein. It is to be noted holes (10) include outside perimeter holes which are substantially 2' in diameter and 2' deep, while the interior holes (10) are substantially 1' in diameter and 2' deep.

After holes (10) are completed and positioned at the desired location of engineering choice, multiple cement foundation blocks (14) are positioned at predetermined locations on excavated ground surface (8) and are equally spaced apart from each other.

Thereafter, girders (16) are positioned on top of cement foundation blocks (14) and are equally spaced apart from each other. Whereby, the cement foundation blocks (14) and girders (16) have a spanning relationship. It is to be noted girders (16) can be of any suitable shape or size of engineering choice, such as 4" high on the Y-axis by 2" wide on the X-axis and 24 or 28' long and made from steel, or the like.

The next step includes placing floor joist assemblies (18) on top of girders (16) with the floor joists (18) being substantially aligned side-by-side. It is to be noted floor joist assemblies (18) can be of any suitable shape or size of engineering choice, such as made from 1½" steel tubing. With the framework of each floor joist comprising a top member (18-A), a bottom member (18-B) and multiple upright supports (18-C) for interconnecting top member (18-A) and (18-B) together. With each of the floor joist assemblies (18) being welded together in substantially the form of a rectangle.

Figure 3:
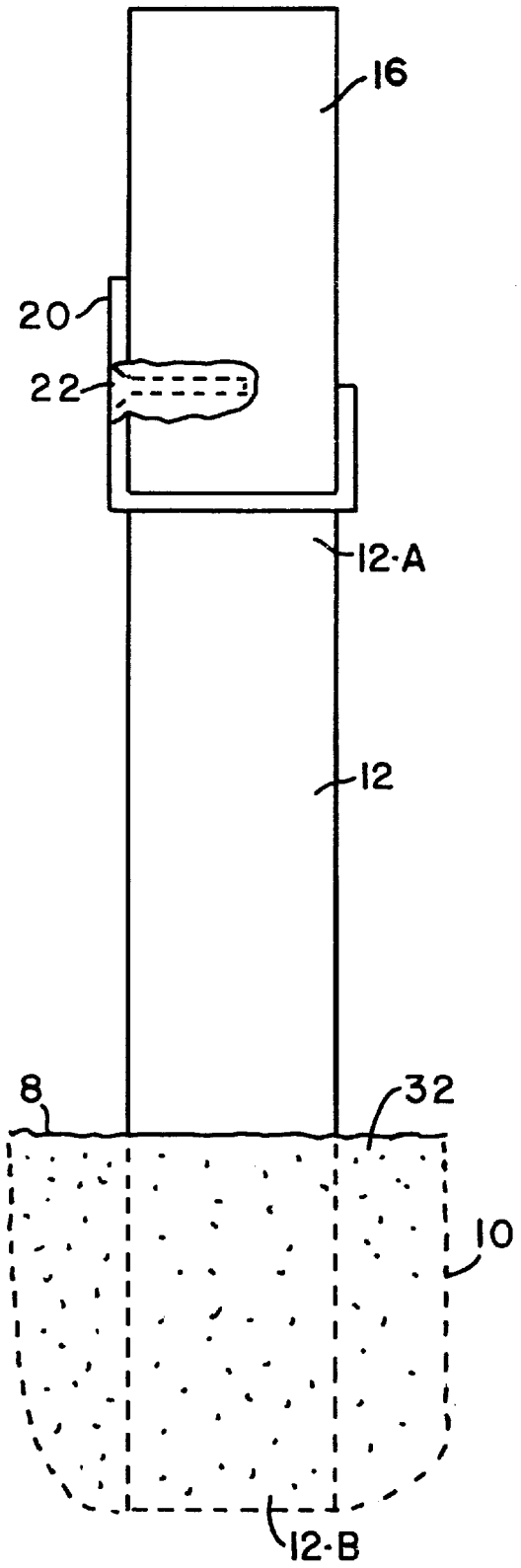
FIG. 3 is substantially a plan view for installation of a pier post when attached to a girder.

Referring now to multiple pier post (12) which are each constructed from 1½" steel tubing and being of a length to substantially extend 2' into the ground after installation. Each pier post (12) having a top end (12-A) and a bottom end (12-B). With the top end (12-A) having an attachment bracket (20) for fixedly attaching each pier post (12) to either the girders (16) or the bottom member (18-B) of each floor joist assembly (18). As illustrated in FIG. 3, bracket (20) is of a shape and size to be slidably engaged onto either the girders (16), or the bottom member (18-B) of each floor joist assembly (18), and fixedly attached in place by a fastener of engineering choice, such as by at least one threaded bolt (22).

Figure 4:
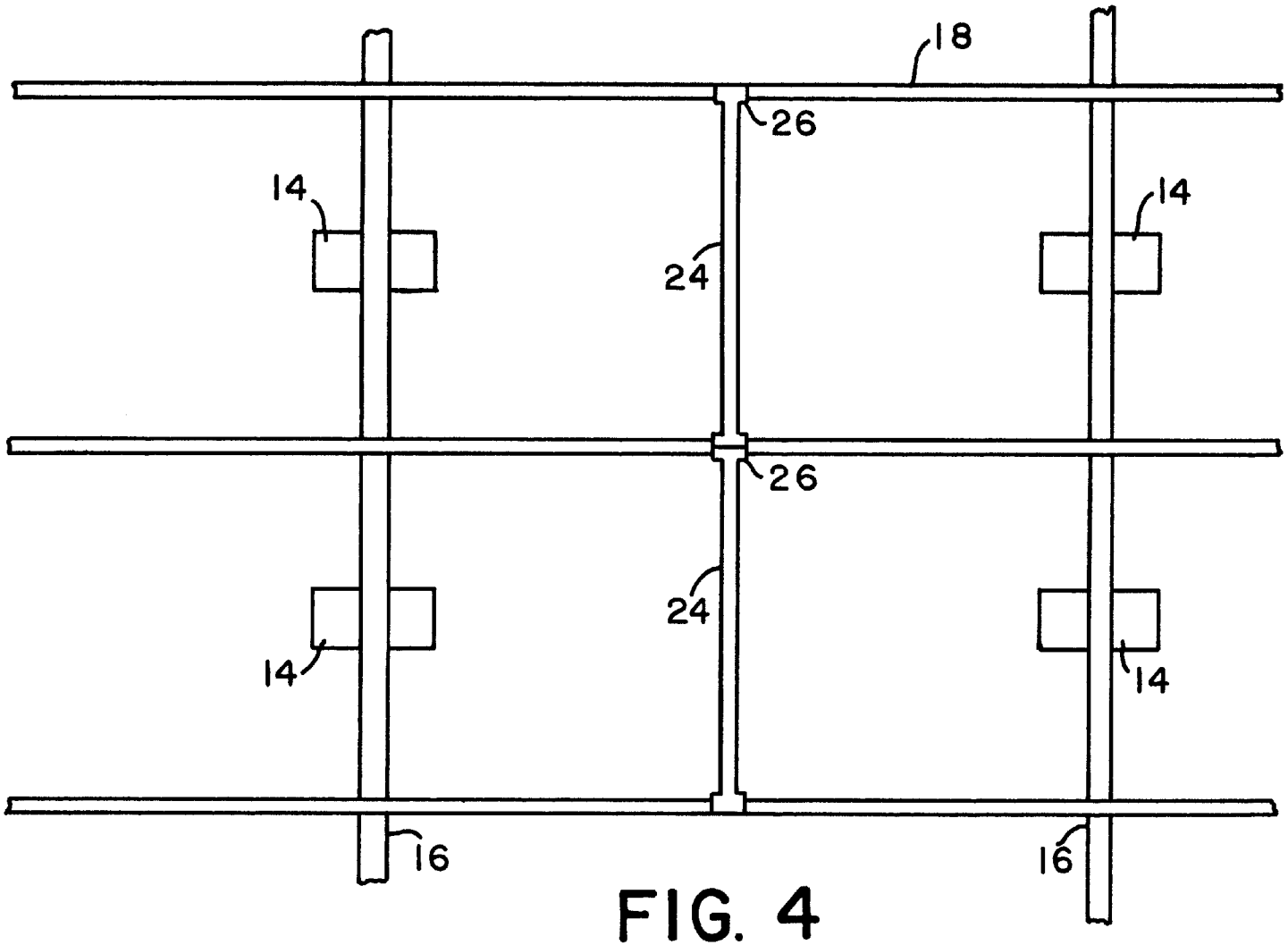
FIG. 4 is substantially a top view showing partial assembly of the foundation blocks, girders, floor joists and spacers.
Figure 5:
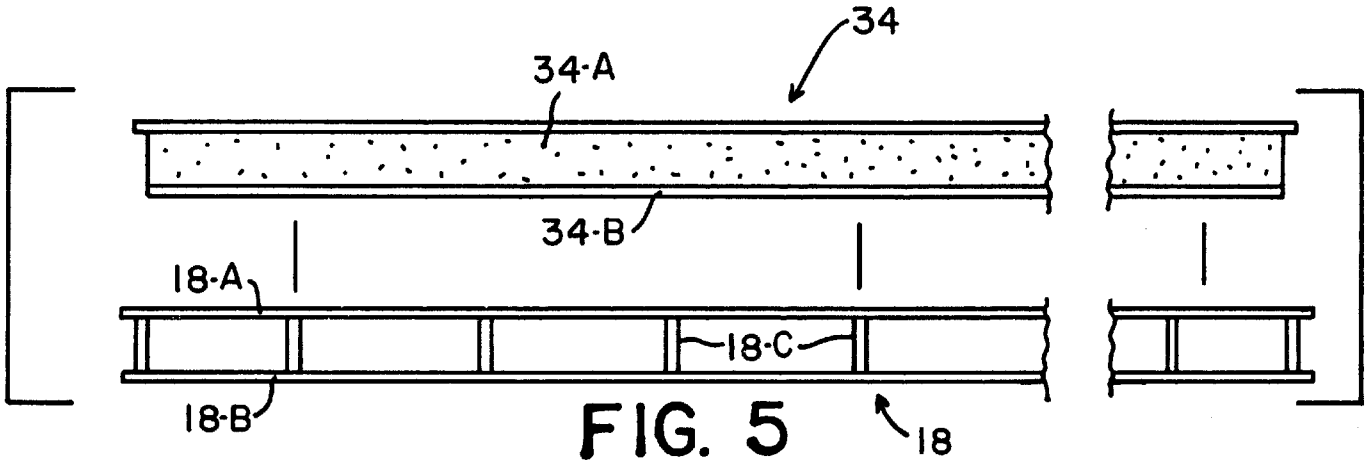
FIG. 5 is substantially a side plan view for positioning an insulated floor panel within the floor joist assembly.
Figure 6:
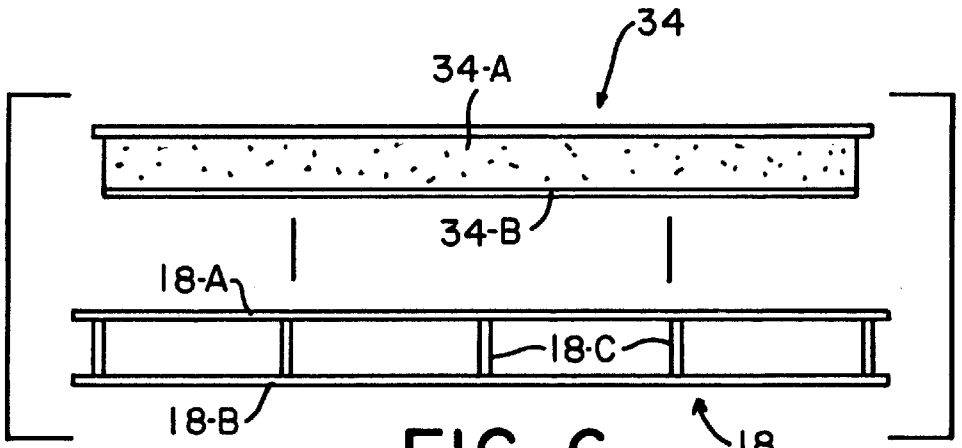
FIG. 6 is substantially an end view of FIG. 5.
Figure 7:
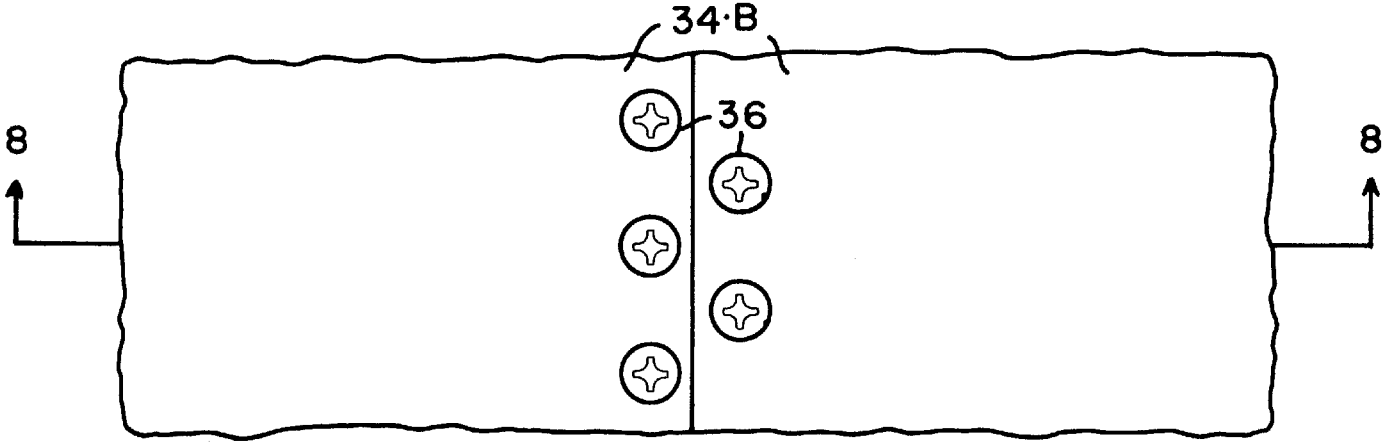
FIG. 7 is substantially a partial top view showing two insulated floor panels when installed within the floor joist assemblies and secured in place with fasteners.
Figure 8:
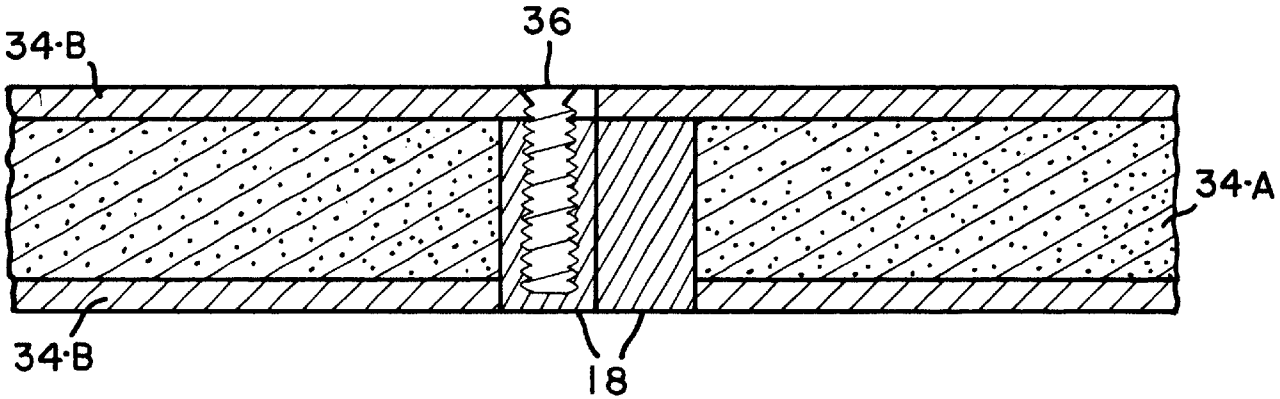
FIG. 8 is substantially a partial cut-a-way taken at 8—8 of FIG.7.

Thereafter, as illustrated in FIG. 4, spacers (24) are slidably engaged within floor joist assemblies (18). Spacers (24) being made from substantially 1½" steel tubing and are of a sufficient length to extend between top members (18-A) of each of the floor joist assemblies (18). Spacers (24) further including a bracket (26) on each end thereof which is of a shape and size to be slidably engaged onto top members (18-A) of floor joist assemblies (18) and be fixedly attached in place by a fastener, (not shown).

Thereafter, as illustrated in FIG. 16, steel wall frame assemblies (28) are installed at their desired location of engineering choice. It is to be noted each of the steel wall frame assemblies (28) are of different configurations with some having framework for windows or doors. This allows for many different types of models to be assembled depending on consumer choice. Furthermore, some of the wall frame assemblies (28) when assembled and interconnected form the steel gable end roof trusses (30). Also the steel gable end roof trusses (30) have attachment means of engineering choice for fixedly attaching steel gable end roof trusses (30) to steel wall assemblies (28), such as the steel gable end roof trusses may be welded thereon at the point of manufacture. Still further each of the various wall frame assemblies (28) are numbered prior to assembly, thus the workers on the building site can simply install the wall frame assemblies (28) in sequence according to the numbers. Each of the wall frame assemblies (28) are made from interconnected steel members which are welded at the factory, with each of the members substantially being formed from 1½" steel tubing, and are each of a shape and size of engineering choice. Each of the wall frame assemblies (28) include attachment means for fixedly attaching the wall frame assemblies (28) onto the exterior surfaces of each floor joist assembly (18) and attachment means for fixedly attaching steel wall assemblies (18) together. In the preferred embodiment each of the above noted attachment means are bolts, washers and nuts (see FIG. 16), but other suitable attachment means of engineering choice may be incorporated.

It will now be seen that on day 1, the general structure for the building has now been assembled and secured in place, including foundation blocks (14), steel girders (16), steel floor joist assemblies (18), pier posts (12), spacers (24), wall frame assemblies (28) and gable end trusses (30).

On day 2, each hole (10) now having the bottom end (12-B) of each pier post (12) embedded therein, is now ready to be filled with cement (32). It is to be noted the unique pier posts (12) and the process of assembly is very important as this allows the pier posts (12) to support the steel girders (16), the floor joist assemblies (18), wall frame assemblies (28) and the gable end trusses (30), prior to construction of any foundation. This is very unlike the known prior art wherein the foundation must always be poured and allowed to cure before any further construction can be performed. Thus, the present invention allows workers to continuously assemble the building while the cement is curing.

Figure 18:
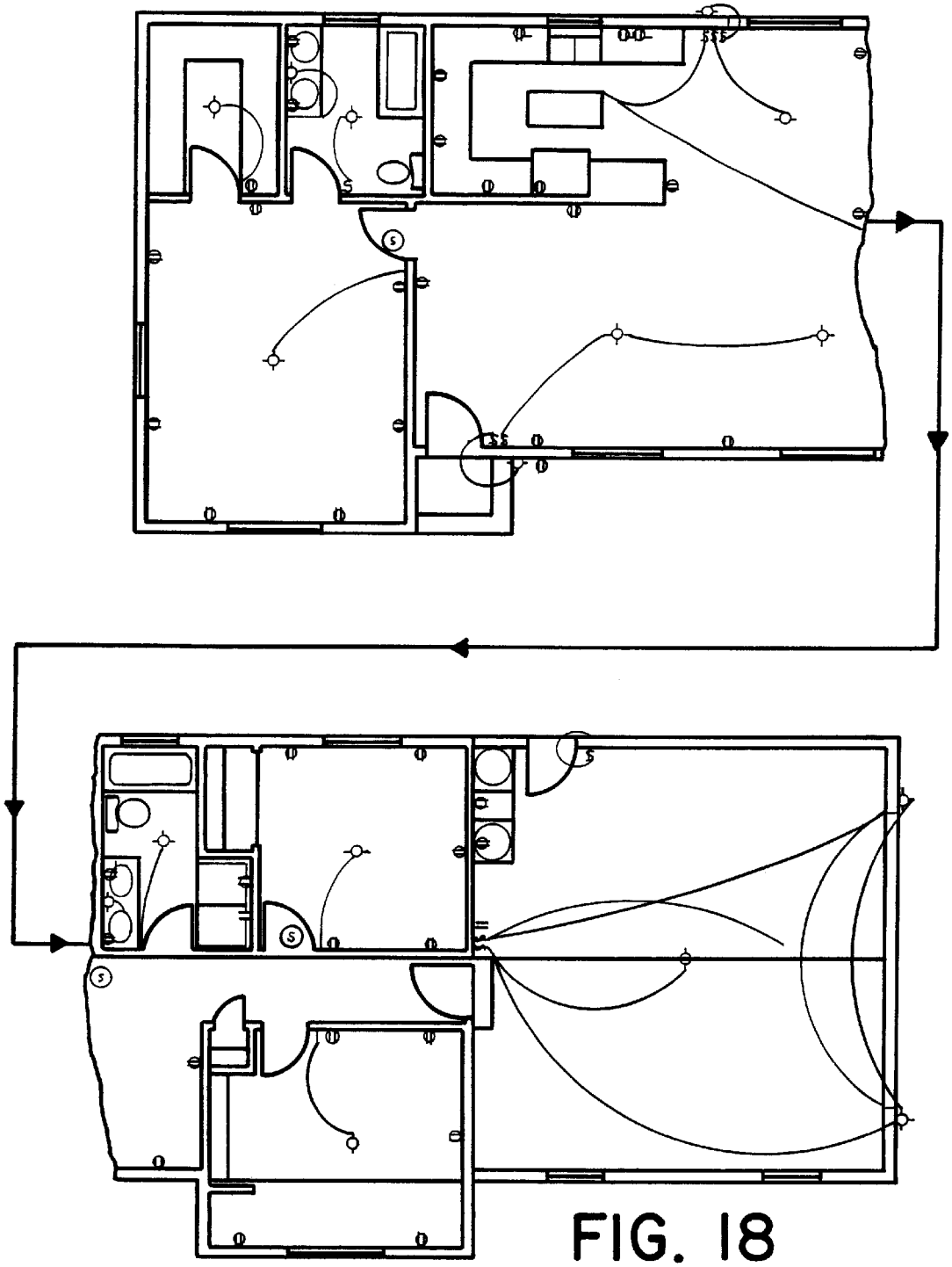
FIG. 18 is substantially an overview illustrating an electrical plan.

Thereafter, or during the pouring of cement the workers install the electrical wiring in the typical manner, such as illustrated in FIG. 18.

On day 3, after the wiring is installed, the multiple insulated floor panels (34) are installed. It is to be noted any suitable floor panels of engineering choice may be used, such as illustrated in FIGS. 5–10 wherein panel (34) is formed having a POLYSTYRENE core (34-A) which is sandwiched between layers of OSB (34-B). also, each of the floor panels (34) may be of any suitable size and shape of engineering choice, such as 24' long by 4' wide, or the like.

Each of the panels (34) are adapted to be slidably positioned and inserted into floor joist assemblies (18), then fixedly attached and supported upon steel floor joist assemblies (18). This being illustrated in FIGS. 5–8, wherein the top layer of OSB (34-B) of panel (34) extends substantially ¾ of an inch outwardly from the POLYSTYRENE core, thus forming a lip. This allows panel (34) to be easily slidably engaged within floor joist (18) with the lip being positioned on top of the floor joist assembly (18), while the POLYSTYRENE panel core is positioned within the floor joist assembly (18). Thereafter as illustrated within FIGS. 7 & 8, a threaded fastener (36) is screwed into the lip and floor joist assembly (18). Thus, securing panel (34) onto the floor joist assembly (18).

Thereafter, multiple roof trusses (38) are to be installed. It is to be noted any suitable roof truss of engineering choice may be used but the roof truss as taught in our co-pending application serial # entitled "ECONOMICAL STEEL BUILDING TRUSS" is preferred and is to be fully incorporated herein. This truss is very efficient and provides numerous unique features. Such as truss (38) is adjustable in height if so desired. Also, the truss (38) includes support legs (as shown within the noted co-pending application) which can be embedded into holes (10) before the cement (32) is poured.

Figure 9:
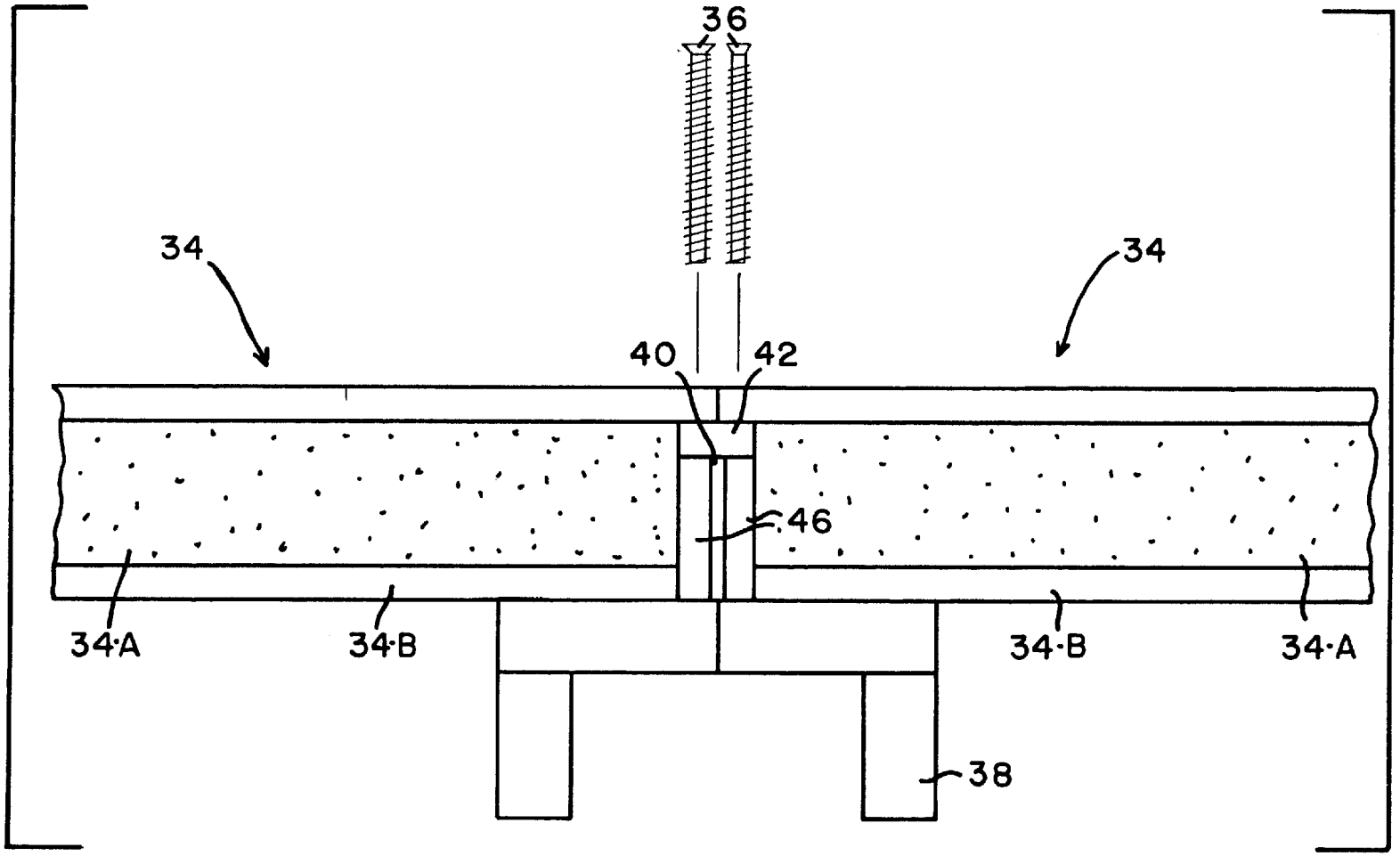
FIG. 9 is substantially a plan view showing one assembly method for attaching the insulated ceiling panels to a truss.

Furthermore as illustrated in FIG. 9, truss (38) may be adapted to include multiple uprights (40) which are welded to an elongated rectangular cross member (42), in such a manner as to form substantially the shape of a "T", and this provides a support shelf and a aeration vent (46). With the shelf being used to secure the previously described lip on each of the multiple insulated ceiling panels (34). It is to be noted each of the steel intermediate roof trusses (38) may include any suitable attachment means of engineering choice for fixedly attaching steel intermediate roof trusses (38) to steel wall assemblies (28), such as by bolts and nuts (not shown).

Figure 17:
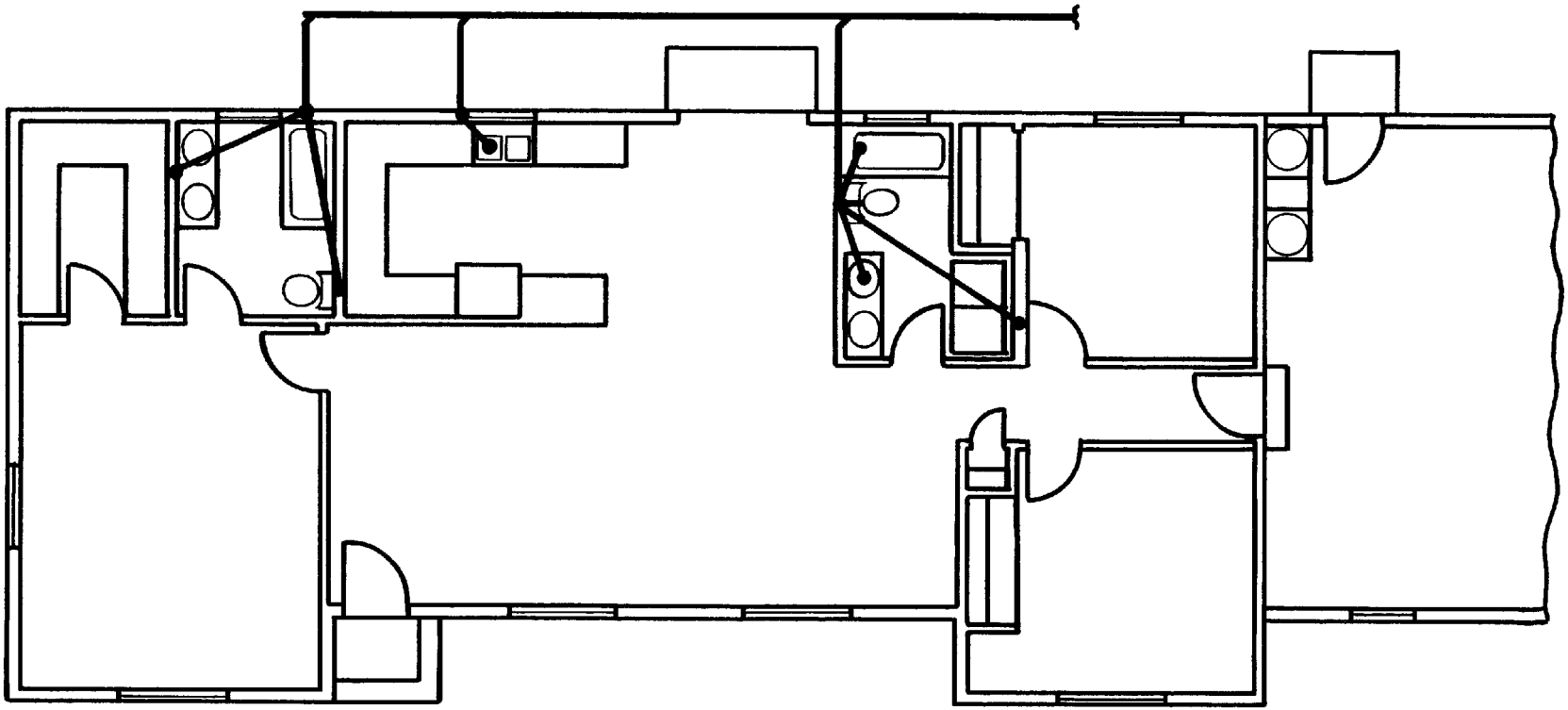
FIG. 17 is substantially an overview illustrating a plumbing plan.

On day 4, plumbing is installed in the typical manner such as illustrated in FIG. 17 and insulated ceiling panels (34) and insulated wall panels (44) are to be installed. It is to be noted insulated ceiling panels (34) are substantially the same shape and size as previously described floor panels (34) and are adapted to be slidably positioned, fixedly attached and supported upon trusses (38 & 30).

While the wall panels (44) are formed from either the ceiling or floor panels (34) by cutting a panel (34) into the desired shape so as to conform and mate with the floor and the variable ceiling angle.

On day 5, the interior walls are finished, the window and door sections are cut from wall panels (44), the wiring and electrical outlets are completed and the workers are off for the weekend.

It will now be seen we have herein completely constructed a steel framed building comprising an insulated floor, walls and a ceiling including electrical and plumbing all within one week's time.

Thereafter, the building is finished in the typical manner, including installing steel wall partitions, finishing interior and exterior walls, installing heating and/or cooling systems, lighting fixtures, kitchen cabinets and counters, bathroom accessories such as the toilet, sink, shower, and carpet, etc. All of which can be completed within substantially less than 3 weeks. Therefore, the overall construction time from beginning to end is about 21 days.

Figure 10:
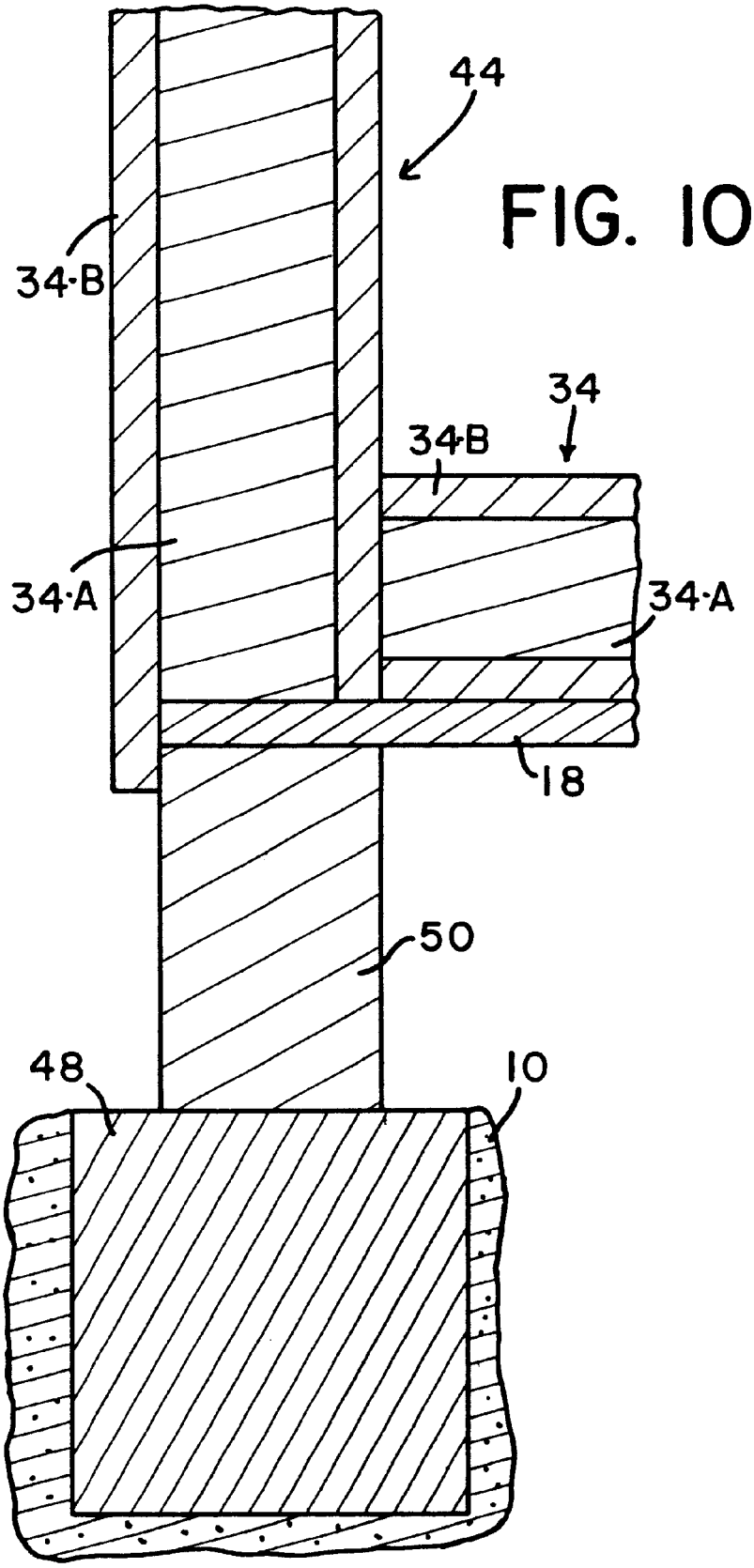
FIG. 10 is substantially a plan view showing an insulated wall panel when mounted onto a curb and foundation.

It is to be noted that if a complete foundation is desired then holes (10) can be in the form of a trench which when filled with cement forms a foundation (48), such as illustrated in FIG. 10. Wherein we show a foundation (48) which forms a support surface for a cement curb (50), which in turn forms a support surface for floor joist assemblies (18) and wall panels (44). It is to be further noted the foundation (48) and curb (50) may be further reinforced in the typical manner, such as with rebar or the like, (not shown).

Figure 11:
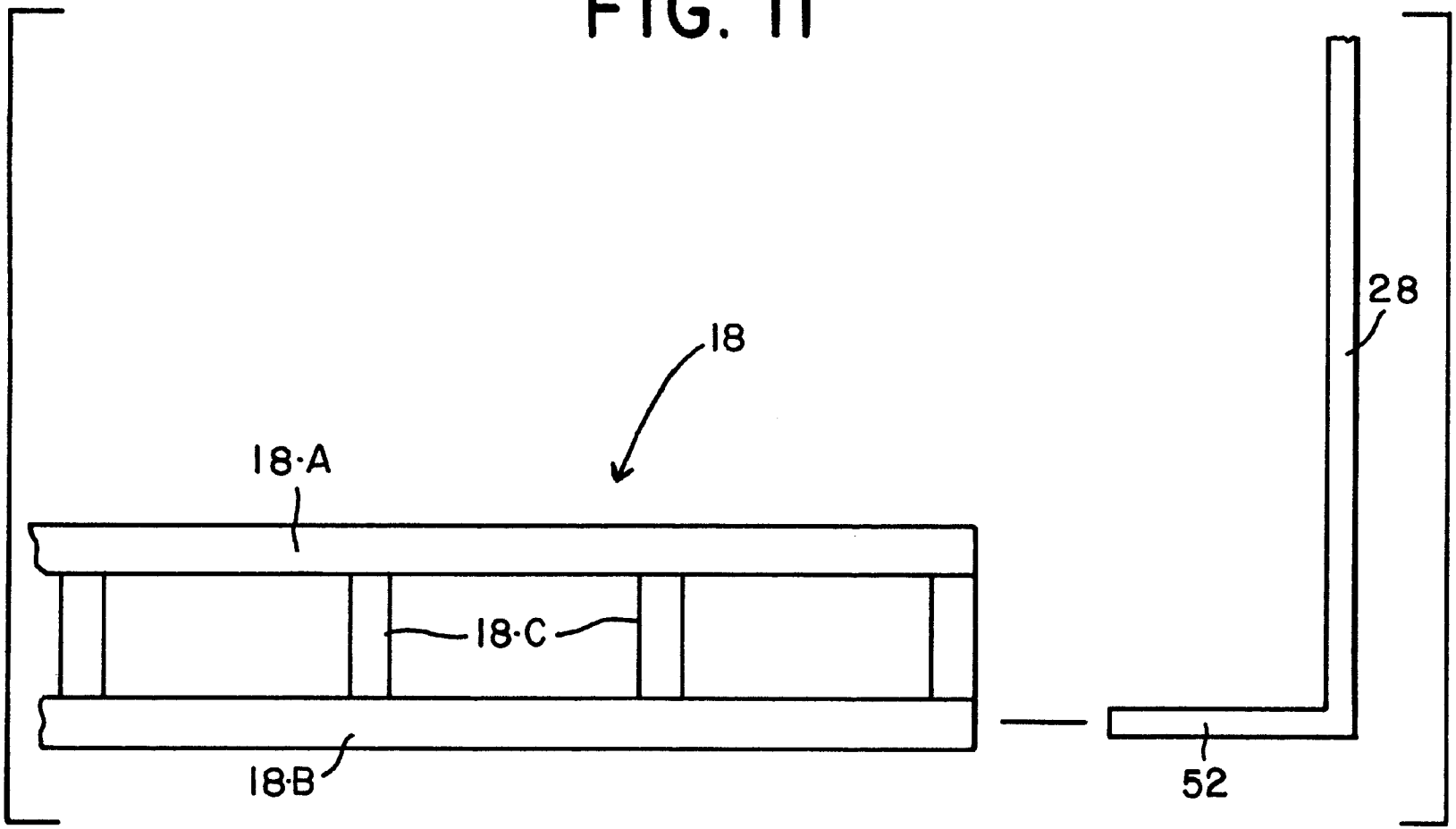
FIG. 11 is substantially a side view showing one assembly method for mounting a wall frame assembly onto a floor joist.
Figure 12:
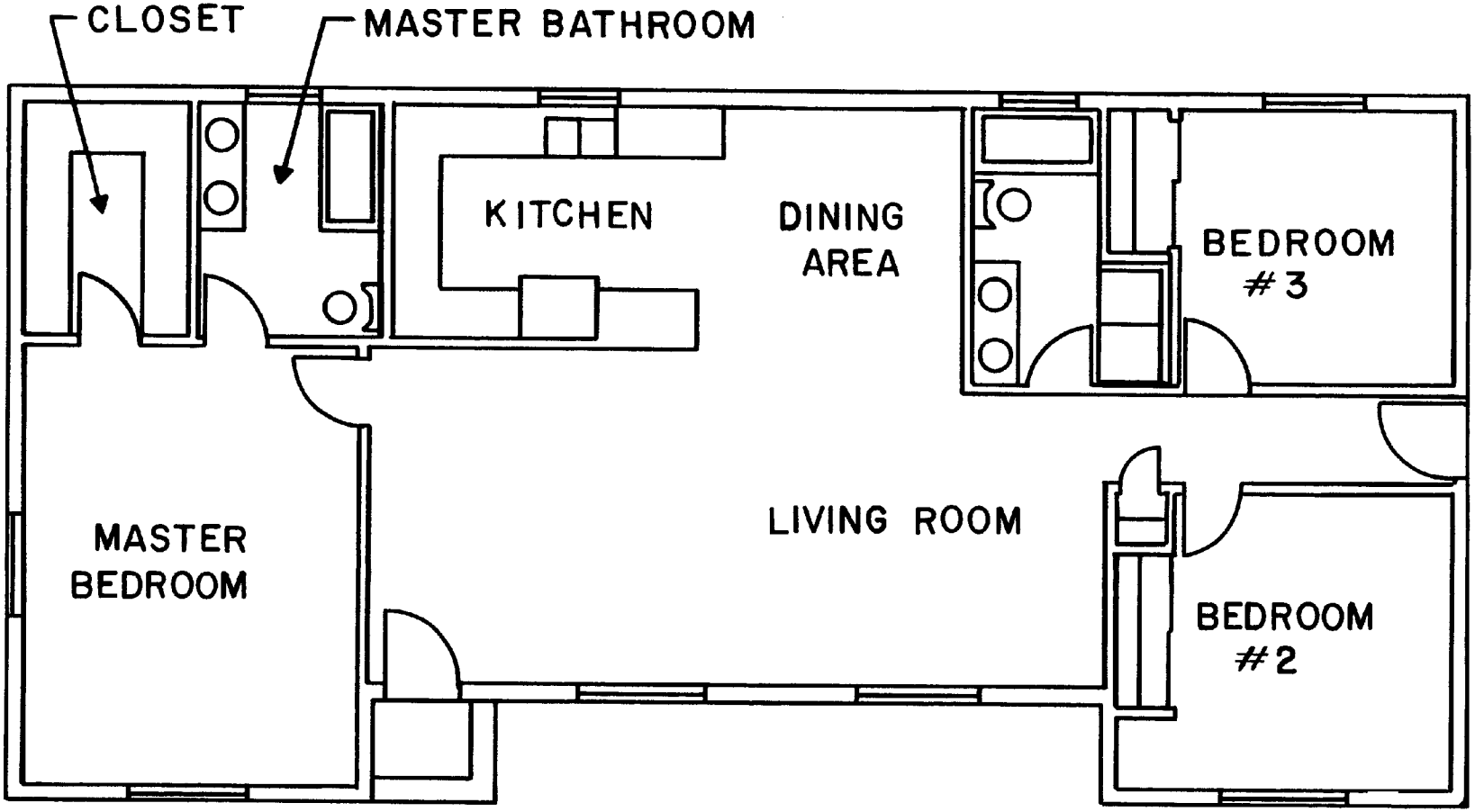
FIG. 12 is substantially an overview of one possible floor plan for the present invention.
Figure 14:
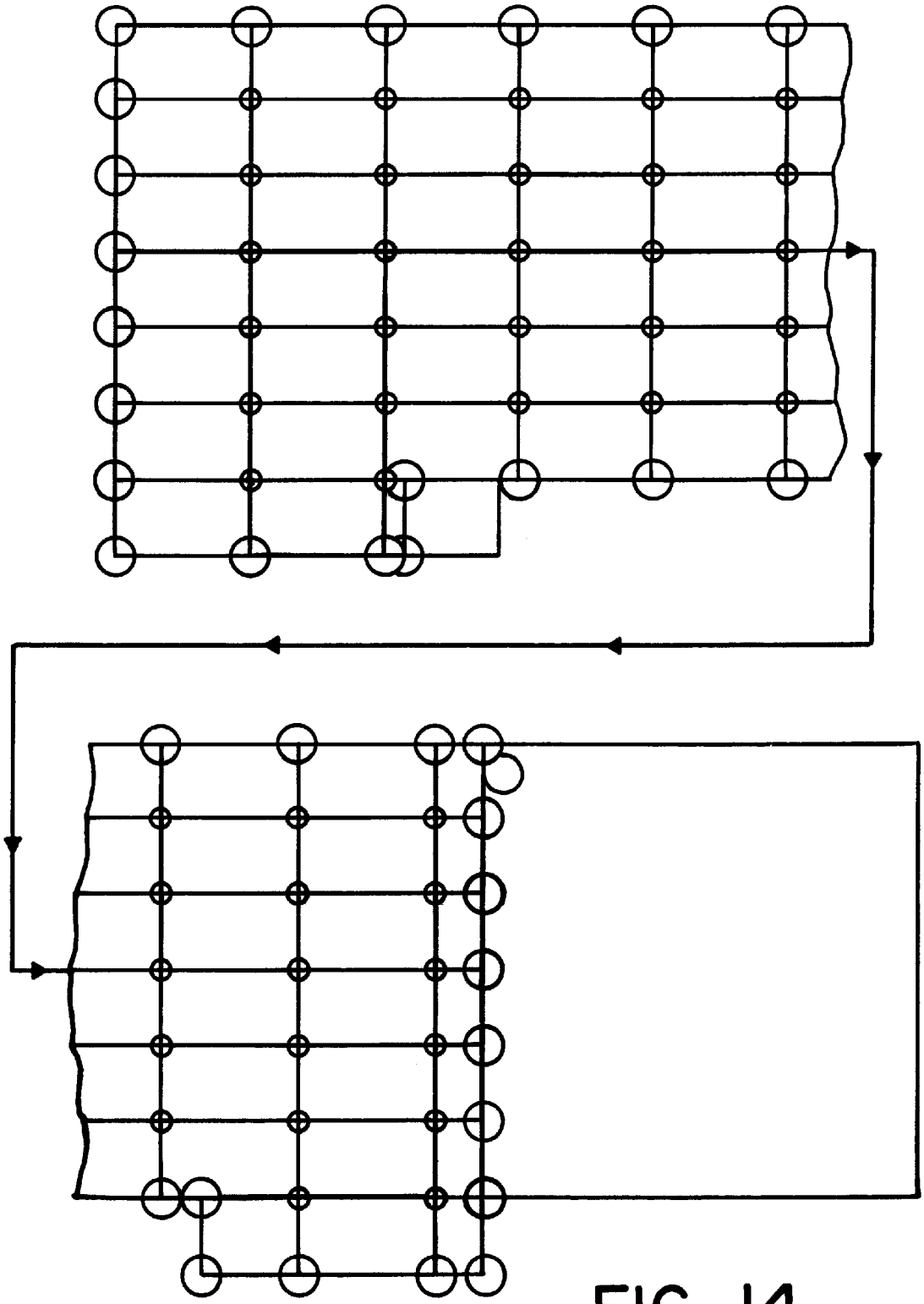
FIG. 14 is substantially an overview of the foundation plan.
Figure 15:
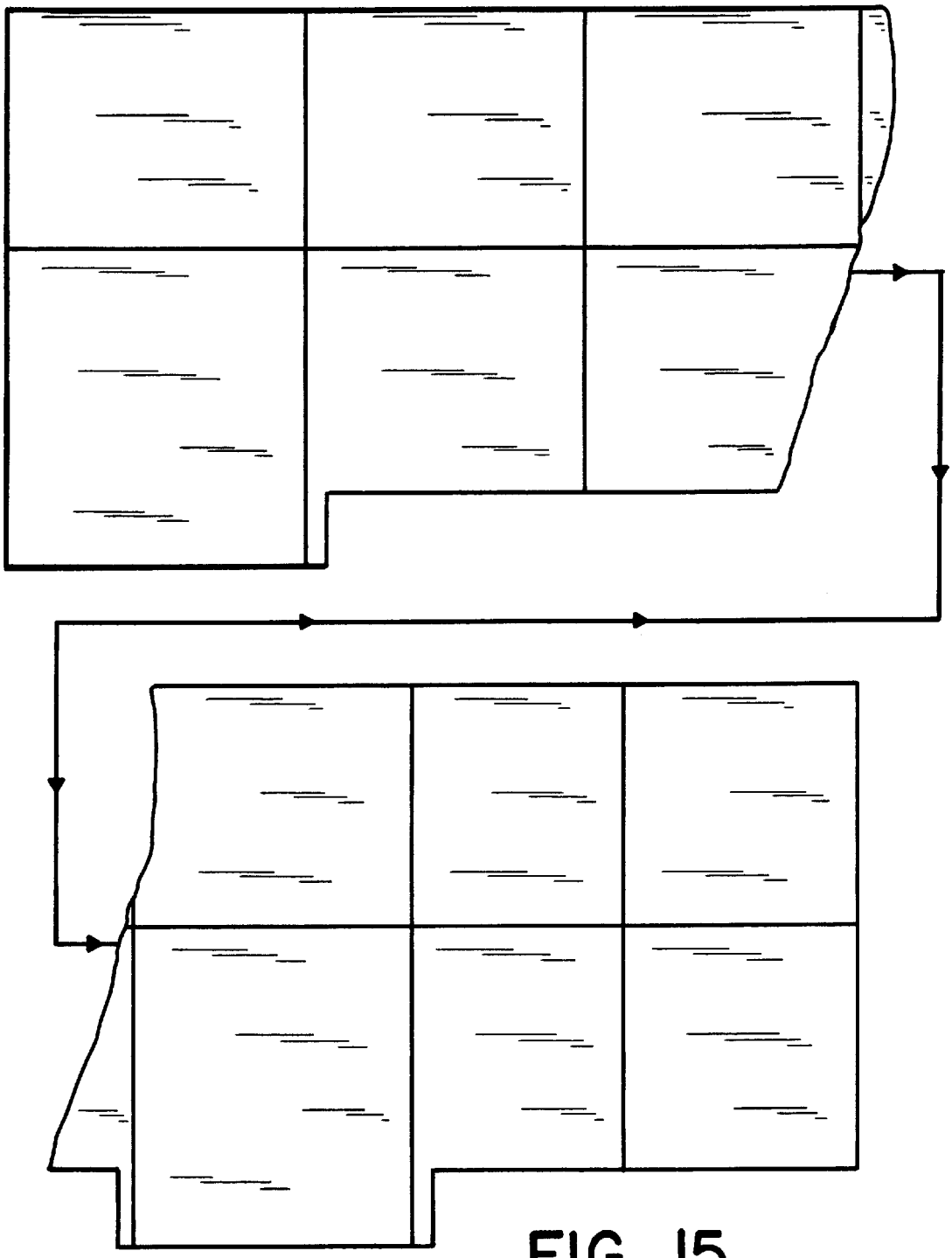
FIG. 15 is substantially an overview of the roofing plan.

As illustrated in FIG. 11, each of the multiple steel wall frame assemblies (28) may include additional attachment means for attaching the multiple steel wall frame assemblies (28) onto the floor joist assemblies (18). Such an attachment means includes elongated support legs (52), which are of a shape and size to be slidably engaged within floor assemblies (18). This facilitates assembly as each of the wall frame assemblies can be positioned and supported by support legs (52) until fasteners are installed.

The following is substantially the method for constructing a building within a predetermined time frame such as 21 days, comprising the steps of:

a. excavating a ground surface (8);

b. digging multiple holes (10) at predetermined spaced apart locations;

c. positioning multiple cement foundation blocks (14) at predetermined spaced apart locations;

d. positioning steel girders (16) at predetermined spaced apart locations on top of cement foundation blocks (14) in a manner which allows cement foundation blocks (14) and steel girders (16) to have a spanning relationship;

e. positioning steel floor joist assemblies (18) side-by-side on top of steel girders (16);

f. attaching steel girders (16) and steel floor joist assemblies (18) together using bolts and nuts;

g. positioning multiple steel pier posts (12) within multiple holes (10);

h. attaching multiple steel pier posts (12) onto multiple steel girders (16) and multiple steel floor joist assemblies (18) using threaded screws (22);

i. positioning multiple steel wall frame assemblies (28) on top of multiple steel floor joist assemblies (18) according to numbers printed thereon;

j. attaching steel wall frame assemblies (28) to multiple steel floor joist assemblies (18) using bolts and nuts;

k. positioning multiple steel gable end roof trusses (30) on top of multiple steel wall frame assemblies (28);

l. attaching multiple steel gable end roof trusses (30) to multiple steel wall frame assemblies (28) using bolts and nuts;

m. positioning multiple steel intermediate roof trusses (38) on top of multiple steel wall frame assemblies (28);

n. attaching multiple steel intermediate roof trusses (38) to multiple steel wall frame assemblies (28) using bolts and nuts;

o. pouring cement (32) into multiple holes (10);

p. installing plumbing in the typical manner;

q. installing electrical in the typical manner;

r. calling for inspection;

s. placing floor glue (not shown) on multiple steel floor joist assemblies (18);

t. positioning multiple insulated floor panels (34) within multiple steel floor joist assemblies (18);

u. attaching multiple insulated floor panels (34) to multiple steel floor joist assemblies (18) using threaded screws;

v. positioning multiple insulated wall panels (44) within multiple steel wall frame assemblies (28);

w. attaching multiple insulated wall panels (44) to multiple steel wall frame assemblies (18) using threaded screws;

x. positioning multiple insulated ceiling panels (34) within roof trusses (30 & 38);

y. attaching multiple insulated ceiling panels (34) to roof trusses (30 & 38) using threaded screws; and z. finishing the building in the typical manner.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. A building system comprising: multiple cement foundation blocks; multiple steel girders; multiple steel floor joist assemblies; multiple steel pier posts; multiple steel wall frame assemblies; multiple steel gable end roof trusses; multiple steel intermediate roof trusses; multiple insulated floor panels; multiple insulated wall panels; and multiple insulated ceiling panels; said cement foundation blocks being equally spaced apart from each other and positioned at predetermined locations on an excavated ground surface, said steel girders being equally spaced apart from each other and positioned on top of said cement foundation blocks, said cement foundation blocks and said steel girders having a spanning relationship, said steel floor joist assemblies being aligned side-by-side and positioned on top of said steel girders, said pier posts each having a top end and a bottom end, said top end of each said pier posts having an attachment bracket for fixedly attaching each said pier posts to one of said steel girders, said bottom end of each said pier posts being embedded into a hole within said ground surface with said hole being filled with cement, said steel wall frame assemblies having attachment means for fixedly attaching said steel wall assemblies to said floor joist assemblies, said steel wall assemblies having attachment means for fixedly attaching said steel wall assemblies together, said steel gable end roof trusses having attachment means for fixedly attaching said steel gable end roof trusses to said steel wall assemblies, said steel intermediate roof trusses having attachment means for fixedly attaching said steel intermediate roof trusses to said steel wall assemblies, said insulated floor panels being adapted to be slidably positioned, fixedly attached and supported upon said steel floor joist assemblies, said insulated wall panels being adapted to be slidably positioned, fixedly attached and supported upon said steel wall frame assemblies, said insulated ceiling panels being adapted to be slidably positioned, fixedly attached and supported upon said trusses; whereby:

said pier posts provide support for said steel girders, said steel floor joist assemblies, said steel wall frame assemblies and said trusses, thus allowing workers to continuously assemble said building while said cement is curing.

2. The building system according to claim 1 wherein each said attachment means are threaded bolts and nuts.

3. The building system according to claim 1 wherein each said panels are fixedly attached by threaded screws.

4. The building system according to claim 1 wherein load bearing walls are eliminated.

5. The building system according to claim 1 wherein said multiple steel wall frame assemblies are numbered for easy assembly.

6. The building system according to claim 1 wherein said hole within said ground surface is in the form of a trench which forms a foundation.

7. A method for constructing a building within a predetermined time frame comprising the steps of:

a. excavating a ground surface;

b. digging multiple holes at predetermined spaced apart locations;

c. positioning multiple cement foundation blocks at predetermined spaced apart locations;

d. positioning steel girders at predetermined spaced apart locations on top of said cement foundation blocks in a manner which allows said cement foundation blocks and said steel girders to have a spanning relationship;

e. positioning steel floor joist assemblies side-by-side on top of said steel girders;

f. attaching said steel girders and said steel floor joist assemblies together using bolts and nuts;

g. positioning multiple steel pier posts within said multiple holes;

h. attaching said multiple steel pier posts to said multiple steel girders and said multiple steel floor joist assemblies using threaded screws;

i. positioning multiple steel wall frame assemblies on top of said multiple steel floor joist assemblies according to numbers printed thereon;

j. attaching said steel wall frame assemblies to said multiple steel floor joist assemblies using bolts and nuts;

k. positioning multiple steel gable end roof trusses on top of said multiple steel wall frame assemblies;

l. attaching said multiple steel gable end roof trusses to said multiple steel wall frame assemblies using bolts and nuts;

m. positioning multiple steel intermediate roof trusses on top of said multiple steel wall frame assemblies;

n. attaching said multiple steel intermediate roof trusses to said multiple steel wall frame assemblies using bolts and nuts;

o. pouring cement into said multiple holes;

p. installing plumbing;

q. installing electrical;

r. calling for inspection;

s. placing floor glue on said multiple steel floor joist assemblies;

t. positioning multiple insulated floor panels within said multiple steel floor joist assemblies;

u. attaching said multiple insulated floor panels to said multiple steel floor joist assemblies using threaded screws;

v. positioning multiple insulated wall panels within said multiple steel wall frame assemblies;

w. attaching said multiple insulated wall panels to said multiple steel wall frame assemblies using threaded screws;

x. positioning multiple insulated ceiling panels within said roof trusses;

y. attaching said multiple insulated ceiling panels to said roof trusses using threaded screws; and z. finishing said building.

* * * * *